US005536282A

United States Patent [19]

Yoon et al.

[11] Patent Number: 5,536,282

[45] Date of Patent: Jul. 16, 1996

[54] METHOD FOR PRODUCING AN IMPROVED VITREOUS BONDED ABRASIVE ARTICLE AND THE ARTICLE PRODUCED THEREBY

[75] Inventors: Soo C. Yoon, Cincinnati; Roger A. Gary, Loveland, both of Ohio

[73] Assignee: Cincinnati Milacron Inc., Cincinnati, Ohio

[21] Appl. No.: 336,366

[22] Filed: Nov. 8, 1994

[51] Int. Cl.[6] ..... B24D 3/02

[52] U.S. Cl. ..... 51/293; 51/298; 51/307; 51/308; 51/309

[58] Field of Search ..... 51/293, 296, 298, 51/307, 308, 309

[56] References Cited

U.S. PATENT DOCUMENTS

| | | | |
|---|---|---|---|
| 4,898,597 | 2/1990 | Hay et al. | 51/298 |
| 4,997,461 | 3/1991 | Markhoff-Matheny | 51/309 |
| 5,009,676 | 3/1991 | Rue et al. | 51/309 |
| 5,035,723 | 7/1991 | Kalinowski et al. | 51/309 |
| 5,118,326 | 6/1992 | Lee et al. | 51/309 |
| 5,129,919 | 7/1992 | Kalinowski et al. | 51/309 |
| 5,131,923 | 7/1992 | Markhoff-Matheny | 51/309 |
| 5,131,926 | 7/1992 | Rostoker et al. | 51/309 |
| 5,194,072 | 3/1993 | Rue et al. | 51/309 |
| 5,203,886 | 4/1993 | Sheldon | 51/309 |
| 5,244,477 | 9/1993 | Rue et al. | 51/309 |

FOREIGN PATENT DOCUMENTS

| | | | |
|---|---|---|---|
| 1474569 | 5/1977 | United Kingdom | B24D 3/34 |
| 9508417 | 3/1995 | WIPO . | |

OTHER PUBLICATIONS

J64002870 Jan. 16, 1989, Abstract Database WPI, Section Ch, Week 8907, Derwent Publications Ltd.

JP64002870 Jan. 16, 1989 Abstract Patent Abstracts of Japan, vol. 13, No. 163 (M-816) 19 Apr. 1989.

JP59161269 Dec. 9, 1984 Abstract Patent Abstracts of Japan, vol. 15, No. 437 (M-1176) 7 Nov. 1991.

*Primary Examiner*—Deborah Jones

*Attorney, Agent, or Firm*—John W. Gregg; Donald Dunn

[57] ABSTRACT

A method is provided that produces grinding wheels which exhibit improved burn reduction or prevention, lower power consumption and increased penetration of metalworking fluid into the grinding zone in high metal removal rate grinding operations such as for example creep feed grinding. The method comprises the steps of preparing a blend, cold pressing the blend in a mold to the desired shape, size and density to form a cold molded article, removing the cold molded article from the mold and firing the cold molded article to produce the vitreous bonded abrasive article wherein the blend comprises aluminum oxide abrasive grains, non-metallic, inorganic, thermally conductive, solid particles having higher thermal conductivity than the abrasive grains and a particle size at least twice that of the abrasive grains, a vitreous matrix precursor which forms a vitreous matrix having a bond with the thermally conductive, solid particles that is weaker than the bond with the abrasive grains and an organic, open cell producing, solid pore inducer that produces spring back of the cold molded article (i.e. green molding) that is at least equal to the smallest particle size of the article size range of the pore inducer.

19 Claims, 1 Drawing Sheet

RA = 0.5 mm

RB = 1.0 mm

RA = 0.5 mm
RB = 1.0 mm

METHOD FOR PRODUCING AN IMPROVED VITREOUS BONDED ABRASIVE ARTICLE AND THE ARTICLE PRODUCED THEREBY

FIELD OF INVENTION

This invention relates to a method for producing vitreous bonded abrasive articles. More particularly this invention relates to a method for producing vitreous bonded abrasive articles, still more particularly grinding wheels, containing thermally conductive solid particles for improved grinding performance.

BACKGROUND OF THE INVENTION

Grinding operations on structural materials (e.g. metallic and ceramic workpieces) typically involves contacting the structural material workpiece with an abrasive article (e.g. grinding wheel) to remove material from and shape the workpiece. Such grinding operations generally involve the input of large amounts of energy (i.e. grinding energy) into the removal of material from the workpiece and often employ high rotating speeds for the abrasive article (e.g. grinding wheel) and/or the workpiece. In some grinding operations it is known to rotate both the grinding wheel and the workpiece. Where high material removal rates, workpieces that are especially tough or hard, high grinding wheel speeds and deep cuts are employed the amount of energy applied to the grinding operation can be and often is very high. This energy in large measure translates into heat that is mostly applied to the workpiece and grinding wheel. The heat often has a detrimental effect on both the grinding wheel and the workpiece. Excessive heat generated during grinding can and often does result in burning of metallic workpieces (ie the formation of a yellow brownish or dark brown to black discoloration on the ground surface of the workpiece). Burning of the metallic workpiece results in a scrapped part. Often the effects of excessive heat generated during grinding can be distortion of the workpiece, out of tolerance parts, changes in the surface appearance and properties of the ground part (e.g. surface hardening effects), excessive break down of the grinding wheel, loss of grinding performance and efficiency, loss of productivity and increase costs.

Creep feed, snagging and cut off grinding operations are high heat generating processes because of the desire for high metal removal rates (i.e. cubic inches of metal removed per unit of time). In snagging and cut off grinding operations the burning of the metal part due to the high generation of heat is not critical because the metal part is in a rough condition after the snagging and cut off operations and is subject to subsequent shaping and finishing steps. The creep feed grinding operation also generates large amounts of heat because of the desire for high metal removal rates in the shaping of the metallic workpiece. However burning of the metallic piece (i.e. the formation of a yellow brown, brownish or brownish black discoloration on the surface) during creep feed grinding operations is a very undesirable condition resulting in the scrapping of the workpiece or article. Additionally, excessive heat generated in a creep feed grinding operation can cause distortion of the part, alteration of the surface appearance and surface properties of the part (e.g. change the surface hardness of the part) and cause the production of an out of tolerance part. Typically in the creep feed grinding operation the metallic workpiece, article or part is fed into a rotating grinding wheel which remains in one location. The rate at which the workpiece is fed into the grinding wheel and the depth of cut are established to maximize the metal removal rate consistent with the desires to produce quality parts, reduce scrap, achieve high grinding efficiency and lower grinding operation costs. Thus the higher the metal removal rate, the greater the G-ratio (i.e. amount of metal removed per unit of grinding wheel lost) without burning the part the greater the efficiency and productivity and the lower the cost of the creep feed grinding operations. Creep feed grinding is used for example in the production of gears. In the production of gears, formed grinding wheels (i.e. wheels having a particular shape) are often used in the creep feed grinding process. It is therefore important that such shaped wheels retain their shape for as long as possible consistent with the other desirable conditions of the creep feed grinding operation (e.g. high metal removal rate, high G-ratio, low heat production and non-burning of workpiece). Although the burning of metallic workpieces and excessive heat generation are of major concern in creep feed grinding operations they are also important concerns in other grinding operations for shaping metallic workpieces to produce useful articles. Such other grinding operations include, for example, surface, internal, plunge and roll grinding operations. Thus it is important and highly desirable to have grinding wheels which produce or contribute to low heat generation during grinding and reduce or eliminate part burn or the risk of part burn while providing high grinding efficiencies and performance, long wheel life and high productivity to reduce grinding operation costs.

It is known to employ metalworking fluids (e.g. water based or oils) in grinding operations to improve grinding performance and efficiency. These fluids are, in many cases, known to reduce friction and remove heat during the grinding operation. Reduction of friction by the fluids can reduce the heat generated during grinding. The ability of these fluids to reduce friction (i.e. friction between the workpiece and the grinding wheel and/or components thereof) and remove heat during grinding can depend upon such factors as the composition of the fluid and the ability of the fluid to penetrate into the grinding zone or interface (i.e. the area of contact between the grinding wheel and the workpiece during grinding). Many metalworking fluids are known to be effective in many grinding operations and have been found to be of value in mild (i.e. low heat generating) grinding operations to improve grinding efficiency or performance. However in severe (i.e. high heat producing) grinding operations (e.g. creep feed grinding) they are often found to be of limited, if any, effectiveness in reducing or preventing part burn when high metal removal rates are sought. In such severe grinding operations it has been found that the metalworking fluids often exhibit poor penetration into the grinding interface, i.e., the region within which material removal occurs, to reduce friction and remove heat.

In the art it is known that different grinding operations (e.g. surface vs internal vs roll vs plunge vs snagging vs cut off vs creep feed grinding) involve different conditions. Such operations therefore often employ for example different forces, speeds, temperatures, infeed rates, metal removal rates and workpiece materials. Some grinding operations (e.g. finish grinding or surface grinding) may employ mild physical conditions involving low forces, low feed rates and low metal removal rates etc. Other grinding operations (e.g. creep feed, plunge and cut off grinding) may employ severe physical conditions involving high forces, high feed rates and high metal removal rates etc. Thus it is known to produce grinding wheels tailored to particular grinding operations and/or workpiece materials. Such wheels may differ in composition (i.e. amount and kind of abrasive grit, bonding material binding together the abrasive grit and additives) and/or structure depending upon their end use. The wheel structure may vary in the amount and type of porosity it contains. The porosity of a grinding wheel, particularly a vitreous bonded grinding wheel, can be of an open and/or closed cell structure. In the open cell porosity the cells or pores are interconnected much like the pores of a sponge or open celled foam. In the closed cell porosity the cells or pores are not interconnected and remain as separated totally enclosed voids much like closed cell foam. Closed cell, rather than open cell, porosity is generally found in resin bonded grinding wheels. The pore structure of a vitreous bonded grinding wheel can serve a number of functions including, for example, controlling the physical strength of the wheel, controlling the breakdown of the wheel to present fresh cutting edges, the elimination of swarf and providing means for getting metalworking fluid to the grinding zone. In a vitreous bonded grinding wheel having an open pore structure it is known to have an essentially random distribution of pore or cell sizes (i.e. some pores being large and other pores being small) and in some cases a random distribution of pores. Thus vitreous bonded grinding wheels can have a heterogeneous open pore structure with respect to pore size and in some cases pore distribution. Pore sizes larger than the abrasive grain average size may be found. Grinding wheels, particularly resin bonded grinding wheels, are known in the art to include thermally conducting particles (e.g. metal particles) to act as heat sinks and improve the dissipation of heat from the grinding wheel. In the case of resin bonded grinding wheels the dissipation of heat from the wheel by such thermally conducting particles serves to protect the poor thermally conducting resin bond from thermally induced breakdown and thus helps protect (i.e. preserve) the strength of the wheel during grinding.

In the grinding process and in particular a grinding operation under severe physical conditions, as are encountered in creep feed grinding operations, using an open cell porosity vitreous bonded grinding wheel, the open pore structure of the wheel can serve as a significant avenue or means by which metalworking fluid can penetrate into the grinding zone or interface and by which metalworking fluid can be captured by the wheel during grinding to reduce friction and remove heat generated during grinding. Such reduction in friction and dissipation of heat are significant factors in reducing or preventing grinding burn of the metallic workpiece, increasing performance and efficiency and lowering the power or energy needed for the grinding operation. These improvements in turn can lead to higher metal removal rates, increased productivity and lower grinding operation costs Vitreous bonded grinding wheels in the prior art are known to be less than desirable in preventing or reducing grinding burn of metallic workpieces under severe physical grinding (e.g. high metal removal rate) conditions even when the grinding operation is carried out in the presence of a metalworking fluid. Thus grinding burn obtained with prior art vitreous bonded grinding wheels under severe physical conditions is known in the art. In many cases, in the art, grinding burn is overcome by reducing the severity of the physical grinding conditions (e.g. reducing metal removal rate and/or infeed rate and/or wheel speed etc.) leading to a loss of productivity and increased grinding costs. Additionally the excessive heat generated during grinding under severe physical conditions with prior art vitreous bonded grinding wheels is often known to lead to scrapped metal parts because of out of tolerance conditions and/or adverse changes in surface appearance and/or properties (e.g. reduction or increase in surface hardness) of the parts. Improvements in vitreous bonded grinding wheels, particularly for use under severe physical grinding conditions, which reduce or prevent grinding burn of metallic workpieces, reduce power or energy consumption during grinding, improve grinding performance and efficiency and increase grinding productivity therefore are needed and desirable. This invention seeks to overcome these and other problems of prior art vitreous bonded grinding wheels, particularly those vitreous bonded grinding wheels used under severe physical conditions in a grinding operation and provide vitreous bonded grinding wheels with improved grinding performance, and improved penetration of metalworking fluids into the grinding zone for reducing or preventing grinding burn of metal workpieces and in reducing the energy or power used in the grinding operation.

SUMMARY OF THE INVENTION

It is an object of this invention to provide a method for producing a vitreous bonded abrasive article, particularly a grinding wheel, that exhibits reduced or no grinding burn on metal workpieces, during grinding at high metal removal rates.

Another object of this invention is to provide a method for producing a vitreous bonded abrasive article, particularly a grinding wheel, which uses lower energy or power during the grinding of metal workpieces at high metal removal rate.

A further object of this invention is to provide a method for producing a vitreous bonded abrasive article, particularly a grinding wheel, permitting improved penetration of a metal working fluid into the grinding zone or interface.

It is a still further object of this invention to provide a method for producing a vitreous bonded abrasive article, particularly a grinding wheel, that improves the removal of grinding heat generated during the grinding of a metal workpiece at high metal removal rates.

These and other objects, as will become apparent to one skilled in the art from the following description and accompanying claims, are achieved by a method for producing an improved vitreous bonded abrasive article, more especially a vitreous bonded grinding wheel, comprising the steps of preparing a blend, cold pressing the blend in a mold to the desired shape, size and density to form a cold molded article, removing the cold molded article from the mold and firing the cold molded article to produce the vitreous bonded abrasive article wherein the blend comprises: a) aluminum oxide abrasive grains, b) non-metallic, inorganic, thermally conductive, solid particles having a thermal conductivity greater than the thermal conductivity of the abrasive grains and an average particle size at least twice the average particle size of the abrasive grains, c) a vitreous matrix precursor which forms a vitreous matrix that binds together the abrasive grains and forms a bond with the thermally conductive solid particles that is weaker than the bond the matrix forms with the abrasive grains and d) an organic, open cell producing, solid pore inducer that, subsequent to the pressing step, produces spring back of the cold molded article in an amount at least equal to the smallest particle size of the particle size range of the pore inducer.

The grinding wheel produced by the method of this invention exhibits improved penetration of metalworking fluid into the grinding zone for greater removal of the heat generated during grinding to thereby reduce or eliminate grinding burn of metal workpieces, especially during high metal removal rate grinding operations such as for example creep feed grinding. This improved penetration of metalworking fluid into the grinding zone aids in maximizing friction reduction between the metal workpiece and the grinding wheel and components thereof. The thermally conductive solid particles of the grinding wheel produced by the method according to this invention can act as heat sinks to further assist in removing heat from the grinding zone to reduce or prevent grinding burn of the metal workpiece.

DESCRIPTION OF THE INVENTION

Figure 1:
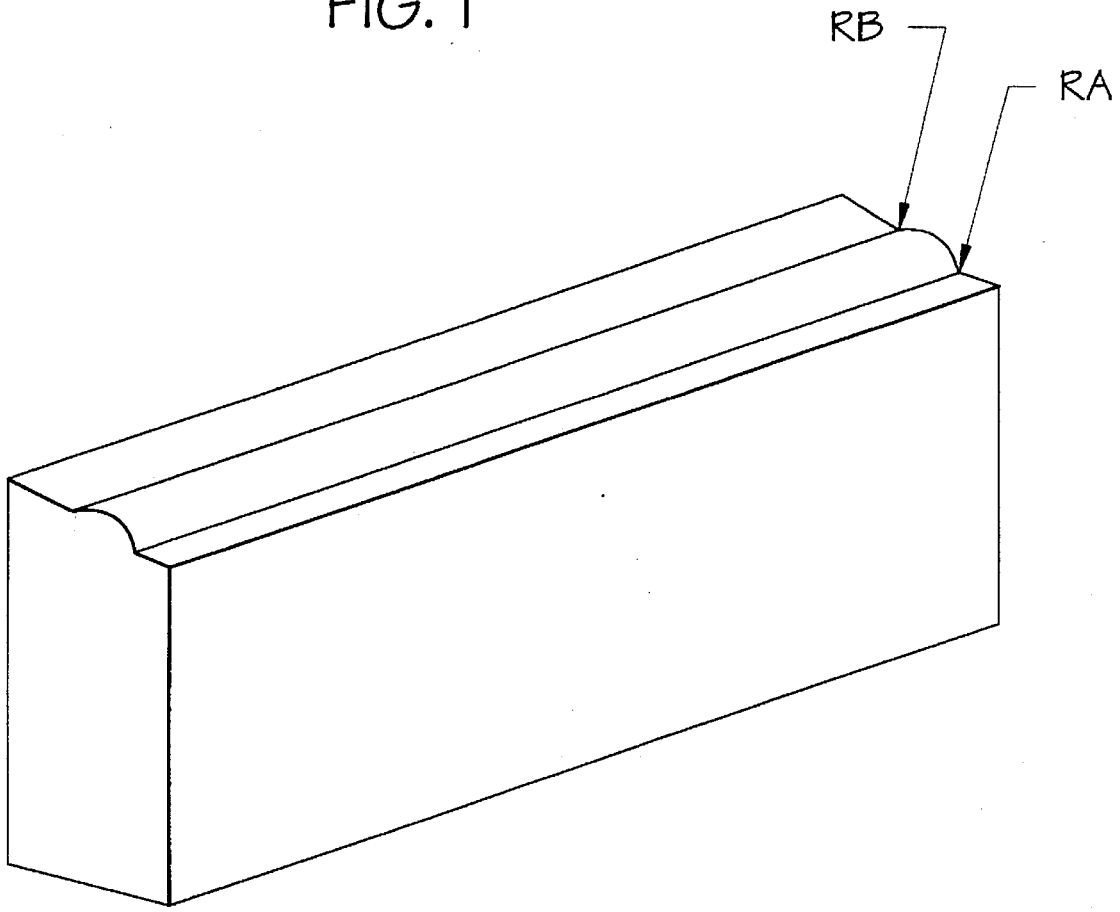
FIG. 1 is a perspective view of the geometry of the metal workpiece used in grinding test number 1.

There has been found in accordance with this invention a method for producing an improved vitreous bonded grinding wheel that overcomes many of the problems occurring with prior art grinding wheels during grinding operations on metal workpieces, particularly where such grinding operations are carried out at high metal removal rates. Such high metal removal rates while varying with the nature of the metal workpiece are especially known in the grinding art in grinding operations commonly called creep feed and plunge grinding. In creep feed and plunge grinding the grinding operation is carried out under conditions (e.g. feed rates, depth of cuts and wheel speed) to maximize the amount of metal removed from the metal workpiece during a single grinding contact between the wheel and the metal workpiece (i.e. a single grinding pass). During the grinding of metal workpieces or parts, particularly at high metal removal rates, it is known in the art that excessive heat can be generated, even with the use of metalworking fluids, that produces a discoloration of the ground metal surface, and sometimes the surrounding area, commonly known as burn. This discoloration is quite visible upon inspection of the ground part and is often a yellow brown to brown to brownish black color which renders the part as scrap. Further the burn can indicate detrimental changes in the physical properties of the surface of the part in the region of the burn (e.g. detrimental changes in hardness) and may also indicate changes in the composition of the metal in the region of the burn. In addition to burn it is known in the art to require high power or energy consumption during grinding at high metal removal rates with vitreous bonded grinding wheels. Such high power or energy consumption often impacts the efficiency and cost of the grinding operation. These and other problems were attacked and solutions sought in arriving at the invention disclosed and claimed herein.

Vitreous bonded abrasive articles, e.g. grinding wheels, are made from blends that contain ingredients to produce voids, i.e. pores, in the fired or vitrified article. These pores are of an open cell or closed cell structure. The vitreous bonded abrasive article may have only open cell pores or only closed cell pores or a mixture of open cell and closed cell pores. Open cell pores are generally produced by the decomposition of an organic constituent of the blend whereas closed cell pores are generally produced by the addition of non-decomposing bubble-like particles to the blend. In the production of vitreous bonded abrasive articles, e.g. grinding wheels, the components of the vitreous bonded abrasive article formulation are combined into a uniform mixture or blend, that mixture or blend placed in a suitable mold at room temperature, the blend in the mold compressed at room temperature to a desired density, nominal dimensions and shape, the self sustaining cold molded article (i.e. green molding) removed from the mold and dried and the dried green molding then fired under appropriate conditions to produce the vitrified abrasive article or grinding wheel. The blends, for producing vitreous bonded abrasive articles, which contain organic, open cell producing pore inducers provide green moldings which may or may not exhibit spring back upon removing the green molding (ie cold molded article) from the mold immediately after pressing. Spring back is the growth (i.e. increase) in thickness of the cold molded article or green molding (e.g. green wheel) over a short period of time after the pressure from pressing is released and the cold molded article or green molding is immediately removed from the mold. This growth decreases with time and eventually essentially reaches zero. Thus, for example, the blend in the mold may be pressed to form a cold molded article having a nominal thickness of 1 inch. Upon releasing the pressure and removing the green molding from the mold the green molding may have a measured thickness let us say of 1.001 inches and at, for example, 5 minutes after being removed from the mold may have a thickness of 1.005 inches. This increase in thickness is a phenomenon called spring back. Generally spring back is an undesirable occurrence because it indicates that the green molding has a thickness greater than that desired for firing the molding or article. There has however been unexpectedly discovered a method, that produces an improved vitreous bonded abrasive article, employing a step of preparing a blend wherein the blend contains organic, open cell producing, solid pore inducers that produce green moldings exhibiting spring back, particularly spring back in an amount at least equal to the smallest particle size of the particle size range of the organic pore inducer, to produce improved vitreous bonded abrasive articles, e.g. grinding wheels, that during a metal abrading, e.g. grinding, operation a) prevent or reduce metal burn at high metal removal rates and high infeed rates, b) exhibit lower power consumption and c) exhibit increased penetration of grinding (ie metal working) fluid into the interface between a grinding wheel and the workpiece (i.e. grinding zone).

In one aspect of this invention there is provided a method for producing an improved vitreous bonded abrasive article, more especially a vitreous bonded grinding wheel, comprising the steps of preparing a blend, cold pressing the blend in a mold to the desired shape, size and density to form a cold molded article, removing the cold molded article from the mold and firing the cold molded article to produce the vitreous bonded abrasive article wherein the blend comprises: a) aluminum oxide abrasive grains, b) non-metallic, inorganic, thermally conductive, solid particles having a thermal conductivity greater than the thermal conductivity of the abrasive grains and an average particle size at least twice the average particle size of the abrasive grains, c) a vitreous matrix precursor which forms a matrix that binds together the abrasive grains and forms a bond with the thermally conductive, solid particles that is weaker than the bond the matrix forms with the abrasive grains and d) an organic, open cell producing, solid pore inducer that, subsequent to the pressing step, produces spring back of the cold molded article in an amount at least equal to the smallest particle size of the particle size range of the pore inducer.

There may be employed as the abrasive grain in the method in accordance with this invention various types or kinds of aluminum oxide (i.e. alumina) abrasive grains individually or in combination or mixture.

Thus, there is provided in accordance with one practice of the method of this invention a blend wherein the abrasive grain comprises sol-gel alumina abrasive grains. In accordance with another practice of the method of this invention there is provided a blend wherein the abrasive grains comprise sintered sol-gel alumina abrasive grains. In a still further practice in accordance with the method of this invention there is provided a blend wherein the abrasive grain comprises fused alumina abrasive grains. There may be provided in accordance with the practice of the method of this invention a blend wherein the abrasive grain comprises a mixture of sol-gel alumina and fused alumina abrasive grains. In another practice in accordance with the method of this invention there is provided a blend wherein the abrasive grain comprises a mixture of sintered sol-gel alumina and fused alumina abrasive grains. This invention may also be practiced to provide in accordance therewith a blend whose abrasive grains comprises a mixture of sintered sol-gel alumina and fused alumina abrasive grains of different sizes.

There is contemplated a method for producing a vitreous bonded abrasive article comprising the steps of preparing a blend, cold pressing the blend in a mold to the desired shape, size and density to form a cold molded article, removing the cold molded article from the mold and firing the cold molded article to produce the vitreous bonded abrasive article wherein the abrasive grain and thermally conductive, solid particles, respectively, of the blend are a) abrasive grain comprising sintered sol-gel alumina abrasive grains and the non-metallic, inorganic, thermally conductive, solid particles are silicon carbide particles having an average particle size of at least twice the average particle size of the sintered sol-gel alumina abrasive grains or b) abrasive grains comprising a mixture of sintered sol-gel alumina abrasive grains and fused alumina abrasive grains and the non-metallic, inorganic, thermally conductive, solid particles are silicon carbide particles having an average particle size of at least twice the average particle size of both the sintered sol-gel alumina and the fused alumina abrasive grains or c) abrasive grain comprising fused alumina abrasive grains and the non-metallic, inorganic, thermally conductive, solid particles are silicon carbide particles having an average particle size of at least twice the average particle size of the fused alumina abrasive grain.

There may be provided in accordance with this invention a method for producing a vitreous bonded abrasive article, preferably a grinding wheel, comprising the steps of preparing a blend, cold pressing the blend in a mold to the desired shape, size and density to form a cold molded article, removing the cold molded article from the mold and firing the cold molded article to produce the vitreous bonded abrasive article wherein the blend comprises: a) sintered sol-gel alumina abrasive grains, the non-metallic, inorganic, thermally conductive, solid particles are silicon carbide particles having an average particle size of at least twice, preferably in the range of from about 2 to 10 times, the average particle size of the sintered sol-gel alumina abrasive grains and an organic, open cell producing, solid pore inducer that, subsequent to the pressing step, produces spring back of the cold molded article in an amount at least equal to the smallest particle size of the particle size range of the pore inducer or b) a mixture of sintered sol-gel alumina abrasive grains and fused alumina abrasive grains, the non-metallic, inorganic, thermally conductive, solid particles are silicon carbide particles having an average particle size of at least twice, preferably in the range of from about 2 to 10 times, the average particle size of both the sintered sol-gel alumina abrasive grains and the fused alumina abrasive grains and an organic, open cell producing, solid pore inducer that, subsequent to the pressing step, produces spring back of the cold molded article in an amount at least equal to the smallest particle size of the particle size range of the pore inducer.

The abrasive grains of the vitreous bonded abrasive article produced in accordance with the method of this invention are aluminum oxide abrasive grains. Aluminum oxide abrasive grains, also called alumina abrasive grains herein, usable in the practice of this invention include for example, but are not limited to, sol-gel alumina, sintered sol-gel alumina, sintered alumina and fused alumina abrasive grains of conventional size well known in the art. Abrasive grain or grit sizes in the range of about 24 to 220, preferably 36 to 150, mesh US Standard Sieve Sizes, are usable in the practice of this invention. Mixtures of alumina abrasive grains differing in composition and/or grain or grit sizes are usable in the practice of this invention. Thus, for example, there may be used a mixture of sintered sol-gel alumina and fused alumina of the same or different grit sizes, mixtures of sol-gel alumina and sintered sol-gel alumina of the same or different grit sizes, mixtures of sintered sol-gel alumina of different grit sizes and mixtures of fused alumina of different grit sizes.

Sol-gel and sintered sol-gel alumina abrasive grains usable in the practice of this invention are well known and described in the art. Various sol-gel alumina and sintered sol-gel alumina abrasive grains usable in this invention, including their composition and method of manufacture, have been described in U.S. Pat. Nos. 4,314,827 to Leitheiser et.al., 4,518,397 to Leitheiser et.al., 4,623,364 to Cottringer et.al., 4,744,802 to Schwabel, 4,770,671 to Monive et.al., 4,881,951 to Wood et.al., 4,898,597 to Hay et.al. and 5,282,875 to Wool et.al. Preferably the sintered sol-gel abrasive grit usable in the method of this invention is a sintered sol-gel, polycrystalline, high density (i.e. at least 95% of theoretical density) alpha alumina abrasive grit, more preferably a sintered sol-gel, submicron, polycrystalline, high density (i.e. at least 95% of theoretical density) alpha alumina abrasive grit. Mixtures having a weight ratio of sintered sol-gel alumina to fused alumina abrasive grains in the range of from 90/10 to 10/90, preferable 10/90 to 75/25 may be used in the practice of the method of this invention.

There are employed in the method, disclosed and claimed herein, non-metallic, inorganic, thermally conductive,solid particles having a thermal conductivity greater than the thermal conductivity of the abrasive grains and an average particle size at least twice the average particle size of the abrasive grain or each of the abrasive grain types of the abrasive grains. Where a mixture of abrasive grains of different grit sizes are used, the non-metallic, inorganic, thermally conductive, solid particles have an average particle size at least twice the average particle size of the abrasive grain having the largest grit size. These thermally conductive solid particles are held by the vitreous matrix with a binding force or strength weaker than the strength of the bond between the abrasive grain and the vitreous matrix. Thus the thermally conductive, solid particles are not part of the vitreous matrix and are more readily lost from the abrasive article (e.g. grinding wheel) during grinding of a workpiece (e.g. metal workpiece) than are the abrasive grains and therefore do not significantly take part in or contribute to the cutting action of the abrasive article or grinding wheel. The thermally conductive, solid particles, having a thermal conductivity greater than the thermal conductivity of the abrasive grains, act as heat sinks to conduct heat away from the grinding zone (i.e. interface between the grinding wheel and workpiece during grinding)

and to distribute and dissipate the heat in and from the grinding wheel to thereby assist in reducing or preventing the risk of a) burn of the metal workpiece and b) thermally induced breakdown of the grinding wheel. The relatively large size of the thermally conductive, solid particles provides a large heat sink potential.

Various non-metallic, inorganic, thermally conductive, solid particles are usable in the practice of this invention. Such thermally conductive, solid particles include, for example, but not limited to silicon carbide, hexagonal boron nitride, graphite, zirconia and titanium carbide. There may be employed non-metallic, inorganic, thermally conductive, solid particles having an average particle size range of from about 10 to 80, preferably 10 to 46 mesh or grit, US Standard Sieve Sizes.

In accordance with the method of the invention disclosed and claimed herein there is employed a vitreous matrix precursor forming a vitreous matrix binding together the abrasive grains and forming a bond between the vitreous matrix and the non-metallic, inorganic, thermally conductive, solid particle that is weaker than the bond between the vitreous matrix and the abrasive grain without destroying or substantially altering the size, composition and properties of the non-metallic, inorganic, thermally conductive, solid particles. The weak bond between the vitreous matrix and the thermally conductive, solid particles allows these particles to more readily break out of the abrasive article (e.g. grinding wheel), during grinding, than does the abrasive. It is desired that the vitreous matrix precursor composition does not react with the abrasive grain in a manner that would have a detrimental effect upon the structure and properties of the abrasive grain.

The vitreous matrix precursor composition employed in this invention is a mixture of materials that, upon firing forms a vitreous matrix binding together the abrasive grains of the abrasive article. This vitreous matrix, also known in the art as a vitreous phase, vitreous bond, ceramic bond or glass bond, may be formed from a combination or mixture of oxides and silicates that upon being heated to a high temperature (e.g. firing temperature) reacts and/or fuses or may be formed from particles of frit that are fused together. Frit is a well known particle form of a vitreous, ceramic or glassy material, produced from oxides and silicates, that upon being heated to a high temperature fuses to form a continuous vitreous matrix. Primarily the oxides and silicates in the vitreous matrix precursor composition may be materials such as metal oxides, metal silicates and silica. The vitreous matrix may, for example have an oxide based composition including silicon dioxide, titanium oxide, aluminum oxide, iron oxide, potassium oxide, sodium, oxide, calcium oxide, barium oxide, boric oxide and magnesium oxide. Temperatures, for example, in the range of from 1000° F. to 2500° F. may be used, in the practice of this invention, for producing the vitreous matrix binding together the abrasive grains. Such heating is commonly referred to as a firing step or firing and is usually carried out in a kiln or furnace where the temperatures and times that are employed in firing the abrasive article are controlled or variably controlled in accordance with such factors as size and shape of the article, the composition and structure of the abrasive grain and the composition of the vitreous matrix precursor. Firing conditions well known in the art may be employed in the practice of this invention.

Pore inducers are organic or inorganic materials that create open or closed cell porosity in the vitreous bonded abrasive article, depending upon the pore inducer material being used. Generally closed cell porosity is produced by inorganic pore inducers because such materials are usually preformed hollow particles whose shape may be retained, upon firing the vitreous bonded abrasive article, to form separated, non-interconnected closed cell pores or voids in the abrasive article. Closed cell pore inducers find particular use in resin bonded grinding wheels, but are also known to be used in vitreous bonded grinding wheels. Open cell porosity in vitreous bonded abrasive articles is produced by organic pore inducers that decompose during firing of the abrasive article to create open, interconnected voids, cells or pores in the vitreous bonded article. The open cell porosity is employed in the practice of this invention. Open cell porosity in vitreous bonded grinding wheels can provide the means by which metalworking fluids, employed in grinding operations, may penetrate into the grinding wheel and into the grinding zone during grinding. Effective penetration of a metalworking fluid into the grinding wheel and grinding zone assists in the utilization of the heat removing and dissipation function of the metalworking fluid during the grinding process. Metalworking fluid may enter and be captured by the open pore structure of a vitreous bonded grinding wheel and subsequently carried into the grinding zone. Alternatively the open pore structure of the grinding wheel, on the face of the wheel engaging the workpiece surface during grinding, creates the clearance for metalworking fluid to enter the grinding zone. The open pore structure of a vitreous bonded grinding wheel, formed by organic pore inducers, is generally in the art only controlled as to the amount of the porosity in the wheel (e.g. volume of porosity). Thus there often results an open pore structure having a very wide range of pore sizes and a non-uniform distribution of pores in the abrasive article. A number of materials, well known in the art, may be employed as the organic, open cell producing, solid pore producers or inducers, in the practice of this invention, to create porosity in the vitreous bonded abrasive article made in accordance with the method of this invention. Such organic pore inducers can include, for example, but are not limited to such materials as crushed nut shells, synthetic polymers, resins and wood flour. Solid organic pore inducers are generally easier to work with in making vitreous bonded abrasive articles and are therefore preferred in the practice of this invention. The organic, open cell producing, solid pore inducer preferably used in this invention is crushed nut shells.

It is known to use various additives in the making of vitreous bonded abrasive articles, both to assist in and improve the ease of making the article and increase the performance of the article. Such additives may include lubricants, fillers, temporary binders and processing aids. These additives, in amounts well known in the art, may be used in the practice of this invention for their intended purpose.

The blend in accordance with the method of this invention may have a wide range of amounts of a) abrasive grains, b) vitreous matrix precursor, c) non-metallic, inorganic, thermally conductive, solid particles and d) organic, open cell producing, solid pore inducer adjusted to various intended uses of the vitreous bonded abrasive article produced by the method of this invention. Thus the vitreous bonded abrasive article produced by the method disclosed and claimed herein may, for example, have, but is not limited to, an abrasive grain content in the range of from about 30 to about 60 volume percent, a vitreous matrix content in the range of from about 2 to about 36 volume percent, a non-metallic, inorganic, thermally conductive, solid particle content in the range of from about 2 to 30 volume percent and a porosity in the range of from about 20 to about 60 volume percent.

Preferably the vitreous bonded abrasive article produced by the method in accordance with this invention has an abrasive grain content in the range of from about 32 to about 50 volume percent, a vitreous matrix content in the range of from about 3 to about 26 volume percent, a non-metallic, inorganic, thermally conductive, solid particle content in the range of from about 4 to about 20 volume percent and a porosity in the range of from about 32 to about 61 volume percent.

Apparatus well known in the art for making vitreous bonded abrasive articles may be used in the method of this invention. Conventional blending and mixing techniques, conditions and equipment well known in the art may be used. Techniques, conditions and equipment well known in the art for pressing the blend to produce a cold molded article can be employed. Drying of the cold molded article prior to firing may be used to remove water or organic solvents usually introduced into the article with the temporary binder. After drying, the cold molded article, usually termed the green article or wheel, may be subjected to high temperatures, e.g. 1000° F. to 2500° F., to form the vitreous matrix holding together the abrasive grain and thus the vitreous bonded abrasive article. This firing step is usually carried out in a kiln where the atmosphere, temperature and the time conditions for heating the article are controlled or variably controlled. Firing conditions well known in the art may be used in the practice of this invention.

The vitreous bonded abrasive article produced by the method invention disclosed and claimed herein is preferably a vitreous bonded grinding wheel for use in high metal removal rate grinding of metal workpieces, more preferably a vitreous bonded grinding wheel particularly adapted for use in a creep feed grinding operation.

This invention will now be further described in the following non-limiting examples wherein, unless otherwise specified, the amounts and percentages of materials are by weight, temperatures are in degrees Fahrenheit, time is in minutes, linear measurements are in inches, mesh or grit is in US Standard Sieve Sizes and wherein 1) Cubitron 321 is a sol-gel alumina abrasive grain in accordance with the disclosure and claims of U.S. Pat. No. 4,881,951 issued Nov. 21, 1989 and obtained from the Minnesota Mining and Manufacturing Company (Cubitron is a registered trademark of the Minnesota Mining and Manufacturing Company);
2) Bond A (vitreous matrix precursor) has a mole % oxide based composition of $SiO_2$ 63.28; $TiO_2$ 0.32; $Al_2O_3$ 10.99; $Fe_2O_3$ 0.13; $B_2O_3$ 5.11; $K_2O$ 3.81; $Na_2O$ 4.20; $Li_2O$ 4.48; CaO 3.88; MgO 3.04 and BaO 0.26;
3) Vinsol is a pine resin obtained from Hercules Inc. (Vinsol is a registered trademark of Hercules Inc.);
4) 3029 UF Resin is a 65% by weight urea formaldehyde resin 35% by weight water composition;
5) Crunchlets CR10 are sugar/starch particles having a weight ratio of sugar to starch of 78.5 to 21.5 and a particle size in the range of from 10 to 30 mesh, obtained from Custom Industries Inc. (Crunchlets is a registered trademark of Custom Industries Inc.);
6) Crunchlets CR20 are sugar/starch particles having a weight ratio of sugar to starch of 78.5 to 21.5 and a particle size in the range of from 16 to 45 mesh, obtained from Custom Industries Inc.
7) Dual Screen Aggregates AD-7 is a ground vegetable shell material having a particle size ranging from −35 to +60 mesh obtained from Agrashell Inc.;
8) Dual Screen Aggregates AD 10.5 is a ground vegetable shell material having a particle size ranging from −60 to +200 mesh obtained from Agrashell Inc. and
9) Rhinolox Bubble Alumina AB 20/36 are bubbled alumina particles (i.e. hollow spheres of alumina) having a size smaller than 20 mesh but larger than 36 mesh (US Standard Sieve Size) obtained from Rhina-Schmelzwerk GMBH of Germany (Rhinolox is a registered trademark of Rhina-Schmelzwerk GMBH).

The components of the formulations or blends in the examples below were combined in the following manner and in accordance with the percentages listed. Where two or more grains of different chemical compositions, physical structure or size were used they were blended together prior to the following steps. The abrasive grain, 3029 UF Resin and ethylene glycol were blended together until uniform coating of the abrasive grains was achieved. To the resulting mixture was added a combination of the bond (vitreous matrix precursor) and dextrin powder with mixing and mixing continued until a uniform mixture was obtained. Vinsol was then added to the mixture with agitation and agitation continued until a uniform blend was produced. Pore inducer particles as called for by the formulation were added to the blend with agitation and agitation continued to form a uniform mixture. The silicon-carbide particles were than added and mixed into the resulting blend and mixing continued until a uniform blend was obtained. This blend or mixture was then screened to remove undesirable lumps and a predetermined amount of the screened mixture or blend was placed and evenly distributed in a steel mold having the size and shape for producing the desired vitreous bonded abrasive article. The blend in the mold was then pressed at room temperature to compact it into the desired shape and dimensions. This compacted blend or cold molded article, commonly called a green article (e.g. green wheel), was then removed from the mold and subjected to a drying cycle by heating it from room temperature to 275° F. over 13 hours and then ambient air cooled back to room temperature. Upon cooling to room temperature the dried green wheel was given a firing cycle in air wherein it was heated from room temperature to 1650° F. over 11 hours, held at 1650° F. for 12 hours, heated from 1650° F. to 2100° F. over 6.5 hours and held at 2100° F. for 3 hours. Thereafter the wheel was cooled in ambient air to room temperature over 27.4 hours and finished to its final dimensions.

EXAMPLE NO. 1

| | |
|---|---|
| Cubitron 321 abrasive (80 grit) | 22.8 |
| White Fused Alumina abrasive (80 grit) | 53.1 |
| Bond A | 8.6 |
| Vinsol | 1.4 |
| Ethylene Glycol | 0.5 |
| 3129 UF Resin | 2.8 |
| Black Silicon Carbide (24 grit) | 3.2 |
| Crunchlets CR 20 | 6.8 |
| Dextrin | 0.8 |

Finished wheel size 16×1×5 inches

EXAMPLE NO. 2

| | |
|---|---|
| Cubitron 321 abrasive (60 grit) | 36.0 |
| White Fused Alumina abrasive (60 grit) | 36.0 |
| Bond A | 10.2 |
| Vinsol | 1.4 |
| Ethylene Glycol | 0.6 |

-continued

| | |
|---|---|
| 3029 UF Resin | 3.0 |
| AB 20/36 Alumina Bubbles | 4.8 |
| Crunchlets CR 10 | 6.8 |
| Dextrin | 1.2 |

Finished wheel dimensions 19×2×8 inches Examples 1 and 2 are comparison formulations and the grinding wheels produced therewith are comparison grinding wheels.

EXAMPLE NO. 3

| | |
|---|---|
| Cubitron 321 abrasive (80 grit) | 23.5 |
| White Fused Alumina abrasive (80 grit) | 54.9 |
| Bond A | 8.9 |
| Vinsol | 1.5 |
| Ethylene Glycol | 0.5 |
| 3029 UF Resin | 2.9 |
| Black Silicon Carbide (24 grit) | 3.3 |
| Dual Screen Aggregates AD 7 | 2.4 |
| Dual Screen Aggregates AD 10.5 | 1.3 |
| Dextrin | 0.9 |

Finished wheel dimensions 16×1×5 inches

EXAMPLE NO. 4

| | |
|---|---|
| Cubitron 321 abrasive (60 grit) | 37.3 |
| White Fused Alumina abrasive (60 grit) | 37.3 |
| Bond A | 10.6 |
| Vinsol | 1.5 |
| Ethylene Glycol | 0.6 |
| 3029 UF Resin | 3.1 |
| Silicon Carbide (24 grit) | 5.0 |
| Dual Screen Aggregate AD 7 | 2.2 |
| Dual Screen Aggregate AD 10.5 | 1.3 |
| Dextrin | 1.2 |

Finished wheel dimensions 19×2×8 inches

EXAMPLE NO. 5

| | |
|---|---|
| Cubitron 321 abrasive (60 grit) | 36.5 |
| White Fused Alumina abrasive (60 grit) | 36.5 |
| Bond A | 12.0 |
| Vinsol | 1.5 |
| Ethylene Glycol | 0.7 |
| 3029 UF Resin | 3.4 |
| Silicon Carbide (24 grit) | 4.9 |
| Dual Screen Aggregates AD 7 | 2.2 |
| Dual Screen Aggregates AD 10.5 | 1.2 |
| Dextrin | 1.2 |

Finished wheel dimensions 19×2×8 inches Examples Nos 3 to 5 are in accordance with this invention Spring Back Measurement Procedure: The required amount of the blended vitreous bonded abrasive article formulation was placed in a 1⅜ inch wide by 5 inch long by 1 inch deep room temperature steel mold having a 1⅜×5 inch open face and the mold placed in a press at room temperature. A force of 37 tons was then applied to the 1⅜×5 inch face of the mixture in the mold for 2 minutes. The force on the mixture was then released and the self sustaining (i.e. green) molding removed from the mold. Metal plates 1 ⅜×5×0.010 inches were immediately placed on each side of the cold pressed molding and the thickness of the sandwich of metal plates and molding was measured with a micrometer. Thickness measurements were again made at 2 minutes and 8 minutes after removing the green molding from the mold. The thickness of the metal plates was then deducted from the thickness of the sandwich to obtain the thickness of the bar. Using this procedure 240.3 grams of the formulation of Example 1 and 232.7 grams of the formulation of Example 3 were cold pressed into bars for spring back measurements. Example 1 and 3 formulations were used at the same volume in the mold.

Results

| | Thickness of test bar (inches) after | | |
|---|---|---|---|
| Formulation | 0 min. | 2 min. | 8 min. |
| Example 1 | 0.989 | 0.989 | 0.989 |
| Example 3 | 0.993 | 0.997 | 1.001 |

| | Spring back (inches) after | | |
|---|---|---|---|
| Formulation | 0 min. | 2 min. | 8 min. |
| Example 1 | 0 | 0 | 0 |
| Example 3 | 0 | 0.004 | 0.008 |

The formulation of Example 1 is a comparison formulation containing an organic, open cell producing pore inducer not producing spring back and the formulation of Example 3 is a vitreous bonded abrasive article formulation in accordance with the method of this invention containing an organic, open cell producing pore inducer producing spring back.

Grinding tests were conducted with the vitreous bonded grinding wheels produced from the formulations of Examples 1 to 5. Wheels produced in accordance with Examples Nos. 1 and 3 were tested and compared in the following continuous creep feed grinding test number 1 and wheels produced in accordance with Examples 2, 4, and 5 were tested in a production grinding test number 2 described below. Grinding wheels using the formulations or blends of Examples 3, 4, and 5 were produced in accordance with the method of this invention, whereas grinding wheels using the formulations of Examples 1 and 2 were not.

Grinding Test No. 1

Procedure: The wheels were tested using continuous creep feed grinding under the conditions described below. Each wheel was dressed 200 um (micrometers) before testing, the dressed wheel having a form to produce a root truncation profile in a workpiece. The ground workpiece geometry is shown in FIG. 1. The depth of cut was held constant at 1 mm (millimeter). A feed rate of 800 mm/min (minute) was selected as the starting point of the test and the feed rate was then increased in steps of 100 mm/min until burn or breakdown of the 0.5 mm radius of the root truncation profile occurred. The power drain on the grinding wheel spindle motor was monitored during the test and a shadowgraph used to measure the actual size of the 0.5 mm radius. Workpiece burn (yellowish brown discoloration) of the ground surface was visually monitored during grinding. Grinding was carried out using a coolant.

Conditions: Wheel Speed 20 meters/second; Depth of cut 1 millimeter; Width of cut 12 millimeters; Length of cut 60 millimeters; Dresser feed rate 1 micrometer per revolution; Dresser speed ratio +0.8; Workpiece material Rene 80 casting (nickel alloy); Coolant Cimperial 22 DB at 3% (a 3% aqueous metalworking fluid obtained from Cincinnati Milacron Inc.—Cimperial is a registered trademark of Cincinnati Milacron Inc.).

Grinding Test No. 1 Results

| Table Speed (mm/min) | Example 1 Burn | Example 1 Break-down* | Example 1 Power** | Example 3 Burn | Example 3 Break-down* | Example 3 Power** |
|---|---|---|---|---|---|---|
| 800 | yes | no | 5.07 | no | no | 4.80 |
| 900 | yes | no | 6.45 | no | no | 5.59 |
| 1000 | yes | no | 6.27 | no | no | 5.60 |
| 1100 | yes | no | 6.81 | no | yes | 6.08 |
| 1200 | yes | no | 7.27 | no | yes | 6.23 |
| 1300 | yes | no | 7.16 | — | — | — |
| 1400 | yes | yes | 7.78 | — | — | — |

*Form breakdown on the 0.5 mm radius
**kW

Grinding Test No. 2

This grinding test was conducted in a production creep feed grinding operation on titanium ductile casting alloy jet engine parts using an ELB Creep Feed Grinder, the grinding wheels produced using the formulations of Example Nos. 2, 4 and 5 and Syntilo 9930 10% aqueous solution metalworking fluid obtained from Castrol Industries Inc. The test was performed to evaluate the grinding performance, under production conditions, of vitreous bonded grinding wheels produced in accordance with the method of this invention. The following results were obtained.

Grinding Wheel

| | Example 2 | Example 4 | Example 5 |
|---|---|---|---|
| Wheel Speed (SFPM)* | 4725 | 6000 | 5500 |
| Table Feed Rate (in/min) | 8.0 | 6.0 | 6.0 |
| Number of Passes** | 2 | 1 | 1 |
| Depth of Cut (inches) | 0.030 | 0.050 | 0.050 |
| Total Machine Cycle Time (sec) | 120 | 58 | 58 |
| Machine Cycle Time per Part (sec) | 60 | 29 | 29 |

*Surface feet per minute
**The number of times contact was made between the wheel and the workpiece to achieve the desired grinding result.

Discussion of Grinding Tests Results

In grinding test number 1 the vitreous bonded grinding wheel produced by the method in accordance with this invention, as produced using the formulation of Example No. 3, exhibited no burn of the metal workpiece over a table speed (i.e. feed rate) of from 800 to 1200 millimeters per minute whereas the comparison wheel, produced using the formulation of Example No. 1 and having the same abrasive and same bond as in Example No. 3, exhibited burn of the metal workpiece over the entire table speed range of 800 to 1200 millimeters per minute. The power required for grinding, in test number 1, with the wheel produced in accordance with the method of this invention, using the formulation of Example No. 3, was lower at each of the table speeds over the table speed range of 800 to 1200 millimeters per minute than the comparison wheel produced using the formulation of Example No. 1. Thus the vitreous bonded grinding wheel produced by the method in accordance with this invention exhibited improved grinding performance over the comparison wheel by reducing or preventing burn of the metal workpiece and at the same time using less power during grinding.

The advantage of the vitreous bonded abrasive grinding wheels produced by the method in accordance with this invention is exemplified in test number 2 by the performance of the wheels produced using the formulations of Example Nos. 4 and 5. Test number 2 was in essence a real life test since it was carried out in a production creep feed grinding operation under production conditions. What test number 2 has shown is that the vitreous bonded grinding wheel produced by the method in accordance with this invention, as produced using the formulations of Example Nos. 4 and 5, out performed the comparison wheel, produced using the formulation of Example 2 having the same abrasive and bond as in Example Nos. 4 and 5, by reducing the number of passes needed to grind the part, achieving significantly greater depth of cut, significantly reducing the total machine cycle time and significantly reducing the machine cycle time per part while not producing burn of the expensive titanium part. Such improved performance translates into reduced grinding cost and increased productivity.

What is claimed is

1. A method for producing an improved vitreous bonded abrasive article comprising the steps of preparing a blend, cold pressing the blend in a mold to form a cold molded article, removing the cold molded article from the mold and firing the cold molded article to produce the vitreous bonded abrasive article wherein the blend comprises:

a) aluminum oxide abrasive grains;

b) non-metallic, inorganic thermally conductive, solid particles having a thermal conductivity greater than the thermal conductivity of the abrasive grains and an average particle size at least twice the average particle size of the abrasive grains;

c) a vitreous matrix precursor which forms a vitreous matrix that binds together the abrasive grains and forms a bond with the thermally conductive solid particles that is weaker than the bond the matrix forms with the abrasive grains and d) an organic, open cell producing, solid pore inducer that, subsequent to the pressing step, produces spring back of the cold molded article in an amount at least equal to the smallest particle size of the particle size range of the pore inducer.

2. The method according to claim 1 wherein the abrasive grain is a sol-gel alumina abrasive grain.

3. The method according to claim 1 wherein the abrasive grain is a fused alumina abrasive grain.

4. A method according to claim 1 wherein the abrasive grain is a mixture of sol-gel alumina and fused alumina abrasive grains.

5. A method according to claim 1 wherein the thermally conductive solid particles have an average particle size of from 2 to 10 times the average particle size of the abrasive grains.

6. The method according to claim 2 wherein the thermally conductive solid particles are silicon carbide particles having an average particle size of from 2 to 10 times the average particle size of the abrasive grains.

7. The method according to claim 3 wherein the thermally conductive solid particles are silicon carbide particles having an average particle size of from 2 to 10 times the average particle size of the abrasive grains.

8. The method according to claim 4 wherein the thermally conductive solid particles are silicon carbide particles having the average particle size of from 2 to 10 times the average particle size of the abrasive grains.

9. The method according to claim 5 wherein the organic, open cell producing, solid pore inducer is crushed nut shells.

10. A method according to claim 6 wherein the organic, open cell producing solid, pore inducer is crushed nut shells.

11. A method according to claim 7 wherein the organic, open cell producing solid, pore inducer is crushed nut shells.

12. A method according to claim 8 wherein the organic, open cell producing solid, pore inducer is crushed nut shells.

13. A vitreous bonded abrasive article produced in accordance with the method of claim 1.

14. A vitreous bonded grinding wheel produced in accordance with the method of claim 7.

15. A vitreous bonded grinding wheel produced in accordance with the method of claim 8.

16. A vitreous bonded grinding wheel produced in accordance with the method of claim 9.

17. A vitreous bonded grinding wheel produced in accordance with the method of claim 10.

18. A vitreous bonded grinding wheel produced in accordance with the method of claim 11.

19. A vitreous bonded grinding wheel produced in accordance with the method of claim 12.

* * * * *